US008197281B2

(12) United States Patent
Yang

(10) Patent No.: US 8,197,281 B2
(45) Date of Patent: Jun. 12, 2012

(54) PLUG CONNECTOR

(75) Inventor: Chih-Lin Yang, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 154 days.

(21) Appl. No.: 12/870,035

(22) Filed: Aug. 27, 2010

(65) Prior Publication Data

US 2012/0052725 A1 Mar. 1, 2012

(51) Int. Cl.
*H01R 12/24* (2006.01)
*H01R 24/00* (2011.01)
*H01R 9/03* (2006.01)

(52) U.S. Cl. ..... 439/499; 439/607.35; 439/607.54; 439/660

(58) Field of Classification Search ..... 439/170, 439/492, 499, 660, 607.35
See application file for complete search history.

(56) References Cited

U.S. PATENT DOCUMENTS 6,039,611 A * 3/2000 Yang ..... 439/701
6,129,594 A * 10/2000 Lai ..... 439/701
6,193,552 B1 * 2/2001 Chiou et al. ..... 439/607.35
6,273,753 B1 * 8/2001 Ko ..... 439/579
6,457,997 B1 * 10/2002 Fan ..... 439/660
6,832,931 B1 * 12/2004 Wu ..... 439/499
6,953,367 B2 * 10/2005 Ji et al. ..... 439/660
6,955,568 B1 * 10/2005 Wu ..... 439/660
7,465,194 B1 * 12/2008 Ho et al. ..... 439/607.01
7,771,237 B2 * 8/2010 Lei et al. ..... 439/607.54
7,798,861 B2 * 9/2010 Liu et al. ..... 439/660
7,833,058 B2 * 11/2010 Zhang et al. ..... 439/607.41
8,011,959 B1 * 9/2011 Tsai et al. ..... 439/607.25
8,052,477 B1 * 11/2011 Ko ..... 439/660
8,070,525 B2 * 12/2011 Hou et al. ..... 439/660
8,113,865 B1 * 2/2012 Yang et al. ..... 439/353
2011/0195609 A1 * 8/2011 Su et al. ..... 439/660
2012/0052713 A1 * 3/2012 Yang et al. ..... 439/353

* cited by examiner

*Primary Examiner* — Neil Abrams
(74) *Attorney, Agent, or Firm* — Wpat, P.C.; Anthony King

(57) ABSTRACT

A plug connector includes an insulating housing of which a rear surface is provided with a plurality of insertion holes, a plurality of terminals disposed in the insulating housing and each having a soldering tail projected beyond the rear surface of the insulating housing, and a propping lid which has a base block mounted against the rear surface of the insulating housing, and a plurality of insertion bolts protruded forwards from a front face of the base block for being inserted into the corresponding insertion holes to make the propping lid detachably mounted to the insulating housing. The soldering tails can be soldered with cables respectively by means of being positioned against a top and a bottom of the base block, or directly soldered onto a printed circuit board by means of demounting the propping lid from the insulating housing to set the soldering tails free.

5 Claims, 3 Drawing Sheets

PLUG CONNECTOR

BACKGROUND OF THE INVENTION

1. Field of the Invention

The present invention relates to a plug connector, and particularly to a plug connector capable of making a propping lid detachably mounted to an insulating housing so as to make soldering tails of terminals soldered not only cables but also a PCB (printed circuit board).

2. The Related Art

A conventional plug connector includes an insulating housing, a plurality of terminals disposed in the insulating housing and having soldering tails projected behind the insulating housing, a shielding shell enclosing the insulating housing, and a propping lid mounted at a rear of the insulating housing. Generally speaking, the shielding shell is coupled with the propping lid to make the propping lid, the shielding shell and the insulating housing secured together. The soldering tails are against a top and a bottom of the propping lid so as to be soldered with cables. However, the foregoing plug connector only is adapted for connecting with the cables, because the propping lid is secured with the shielding shell to always prop the soldering tails. When the soldering tails need to be connected with a PCB, another plug connector without the propping lid is required.

SUMMARY OF THE INVENTION

Accordingly, an object of the present invention is to provide a plug connector. The plug connector includes an insulating housing having a base body and a tongue portion protruded forwards from a front of the base body, a plurality of terminals disposed in the insulating housing, a shielding shell having a casing for surrounding the tongue portion of the insulating housing and a rear coupled with the base body of the insulating housing, and a propping lid. A rear surface of the base body is provided with a plurality of insertion holes spaced from one another and each concaved forward. Each of the terminals has a soldering tail projected beyond the rear surface of the base body. The propping lid has a base block mounted against the rear surface of the base body, and a plurality of insertion bolts protruded forwards from a front face of the base block for being inserted into the corresponding insertion holes of the base body to make the propping lid detachably mounted to the insulating housing. The soldering tails of the terminals can be soldered with cables respectively by means of being positioned against a top and a bottom of the base block, or directly soldered onto a printed circuit board by means of demounting the propping lid from the insulating housing to set the soldering tails free.

As described above, the propping lid has the insertion bolts protruded from the base block to be inserted in the corresponding insertion holes of the insulating housing, so as to make the propping lid detachably mounted to the insulating housing. Such structures make the soldering tails of the terminals capable of being soldered with not only the cables but also the PCB, by means of mounting the propping lid to the rear of the insulating housing to position the soldering tails or demounting the propping lid from the insulating housing to set the soldering tails free. So the plug connector can be widely used in electronic products to meet different demands.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
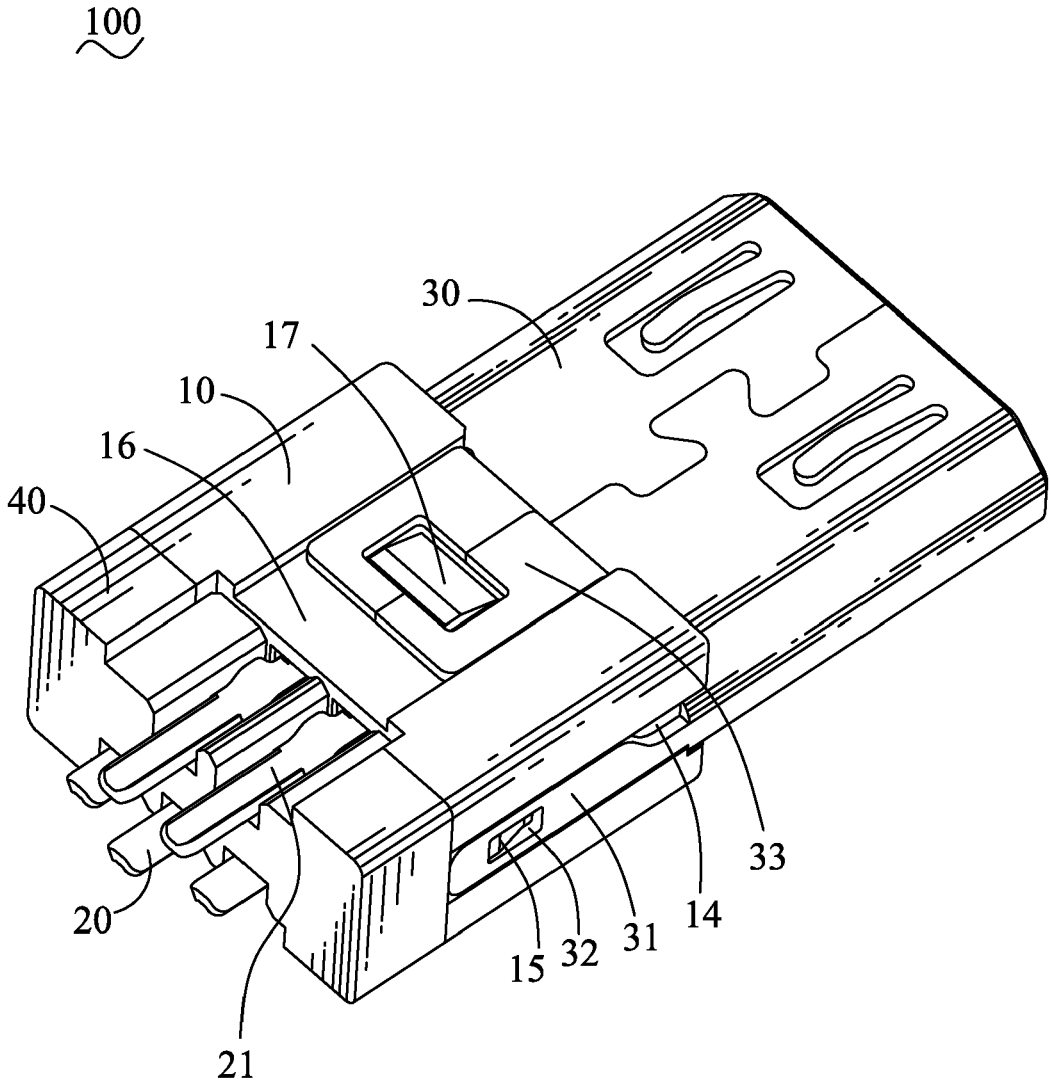
FIG. 1 is an assembled perspective view of a plug connector in accordance with the present invention.
Figure 2:
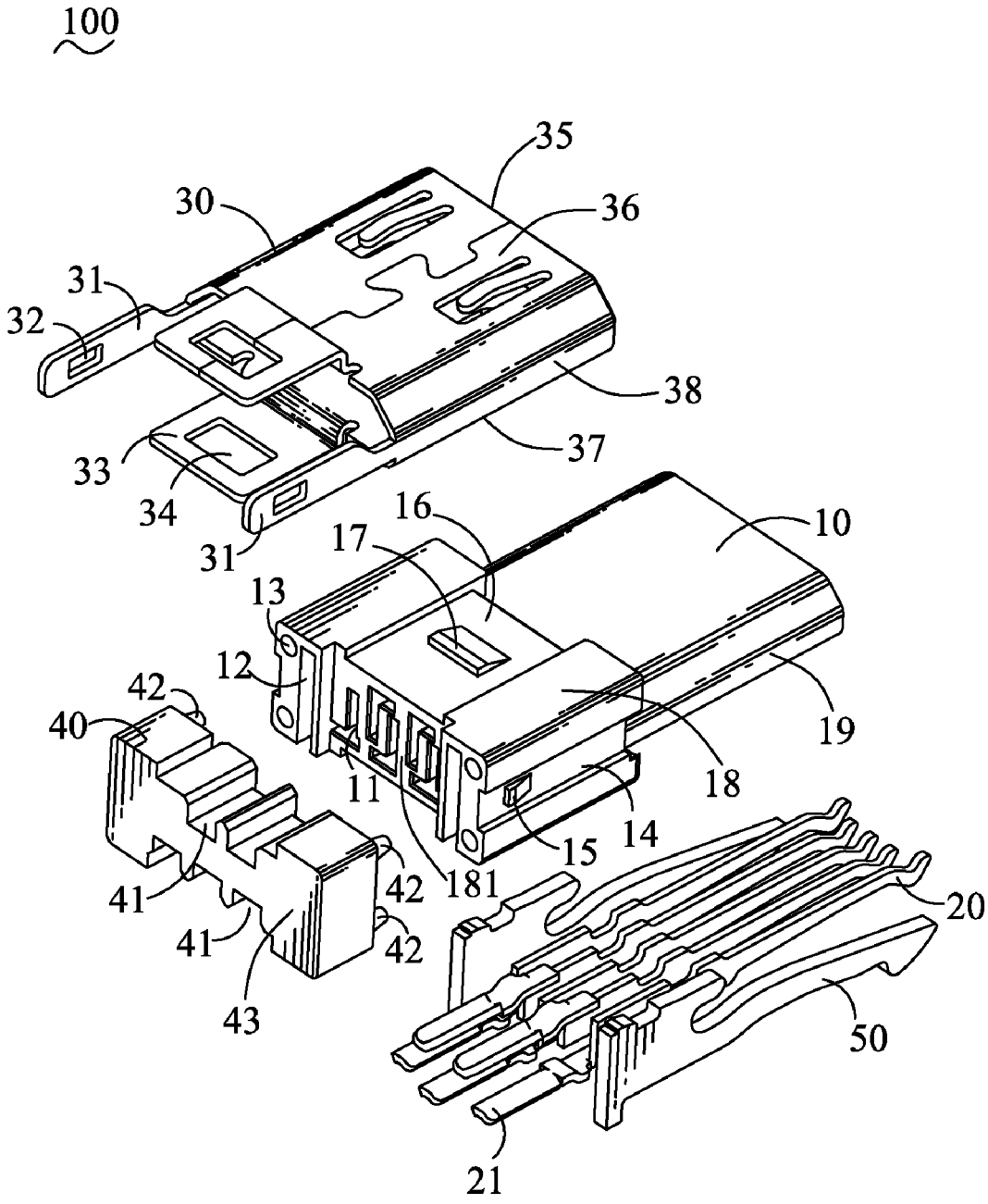
FIG. 2 is an exploded perspective view of the plug connector of FIG. 1.

Referring to the drawings in greater detail, and first to FIG. 1 and FIG. 2, the embodiment of the invention is embodied in a plug connector 100. The plug connector 100 includes an insulating housing 10, a plurality of terminals 20 and a pair of latches 50 mounted to the insulating housing 10 respectively, a propping lid 40 mounted at a rear of the insulating housing 10, and a shielding shell 30 coupled with the insulating housing 10.

With reference to FIG. 2, the insulating housing 10 has a rectangular base body 18 and a tongue portion 19 protruded forwards from a middle of a front surface of the base body 18 for being inserted into a mating socket connector (not shown) along a front-to-rear direction. The base body 18 has two indentation areas 16 oppositely provided at middles of top and bottom surfaces thereof. The indentation area 16 is enlarged to the front surface of the base body 18. A wedge 17 is formed at a center of each indentation area 16. A bottom of the tongue portion 19 defines a plurality of terminal grooves 11 arranged at regular intervals along a transverse direction thereof and each extending longitudinally to penetrate through the base body 18. The insulating housing 10 further defines a pair of receiving slots 12 located at two outmost sides of the terminal grooves 11 and each extending longitudinally to penetrate through the base body 18 and the bottom of the tongue portion 19. A pair of fastening cavities 14 is opened at substantial middles of two opposite sides of the base body 18, and each extends longitudinally to penetrate through the front surface of the base body 18. A locking bump 15 protrudes at each of the fastening cavities 14. Two opposite ends of a rear surface 181 of the base body 18 are provided with a plurality of insertion holes 13 each concaved forward with a diameter thereof gradually shortened.

Referring to FIG. 2 again, the shielding shell 30 has a rectangular casing 35 for enclosing the tongue portion 19 of the insulating housing 10 therein. The casing 35 has a top plate 36, a bottom plate 37 facing the top plate 36, and two opposite side strips 38 connecting the top plate 36 and the bottom plate 37. Middles of rear edges of the top plate 36 and the bottom plate 37 are oppositely bent perpendicularly to the top plate 36 and the bottom plate 37, and then extend rearwards to form a pair of buckling slices 33. A buckling opening 34 is opened at a center of each of the buckling slices 33. Each of the side strips 38 is elongated rearwards to form a clamping arm 31, with a locking hole 32 being opened therein. The propping lid 40 has a substantially rectangular base block 43 and a plurality of insertion bolts 42 protruded forwards from two opposite ends of a front face of the base block 43. The insertion bolt 42 is of substantially columned shape and gradually thins in diameter along the extending direction thereof. A top and a bottom of the base block 43 respectively define a plurality of positioning fillisters 41 arranged at regular intervals and each extending along a front-to-rear direction to penetrate through the base block 43.

Figure 3:
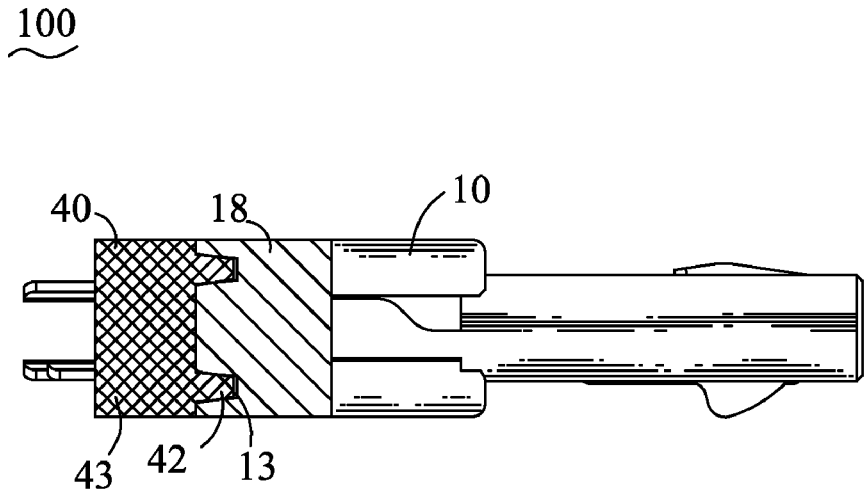
FIG. 3 is a cross-sectional view of the plug connector of FIG. 1.
Figure 4:
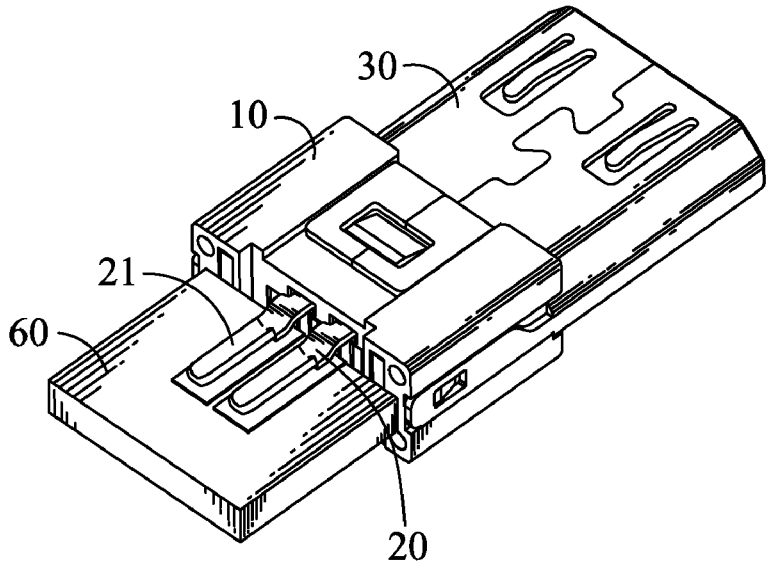
FIG. 4 is a perspective view showing that the plug connector of FIG. 1 is soldered with a PCB.

Referring to FIG. 1, FIG. 2 and FIG. 3, in assembly, the terminals 20 are disposed in the corresponding terminal grooves 11 of the insulating housing 10 and have soldering tails 21 thereof projected beyond the rear surface 181 of the base body 18. The latches 50 are inserted forwards in the corresponding receiving slots 12. The casing 35 of the shielding shell 30 surrounds the tongue portion 19 of the insulating housing 10. The buckling slices 33 are disposed in the indentation areas 16 respectively, and the wedges 17 are buckled in the corresponding buckling openings 34 for fixing the shielding shell 30 to the insulating housing 10. The clamping arm 31 is inserted in the corresponding fastening cavity 14 of the insulating housing 10, with the locking bump 15 being buckled in the locking hole 32 to further fix the shielding shell 30 and the insulating housing 10 together. The propping lid 40 is detachably mounted to a rear of the base body 18 of the insulating housing 10 by means of the insertion bolts 42 being inserted in the corresponding insertion holes 13, wherein the base block 43 abuts against the rear surface 181 of the base body 18 to secure the terminals 20 and the latches 50 in the insulating housing 10. The soldering tails 21 of the terminals 20 are positioned in the positioning fillisters 41 of the propping lid 40 respectively to be propped by the base block 43, so that can facilitate the soldering tails 21 to be soldered with cables (not shown). In FIG. 4, the propping lid 40 is demounted from the insulating housing 10 to make the soldering tails 21 of the terminals 20 directly soldered onto a PCB 60.

As described above, the propping lid 40 has the insertion bolts 42 protruded from the base block 43 to be inserted in the corresponding insertion holes 13 of the insulating housing 10, so as to make the propping lid 40 detachably mounted to the insulating housing 10. Such structures make the soldering tails 21 of the terminals 20 capable of being soldered with not only the cables but also the PCB 60, by means of mounting the propping lid 40 to the rear of the insulating housing 10 to position the soldering tails 21 or demounting the propping lid 40 from the insulating housing 10 to set the soldering tails 21 free. So the plug connector 100 can be widely used in electronic products to meet different demands.

The foregoing description of the present invention has been presented for the purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. A plug connector, comprising:

an insulating housing having a base body and a tongue portion protruded forwards from a front of the base body, a rear surface of the base body being provided with a plurality of insertion holes spaced from one another and each concaved forward;

a plurality of terminals disposed in the insulating housing, each of the terminals having a soldering tail projected beyond the rear surface of the base body;

a shielding shell having a casing for surrounding the tongue portion of the insulating housing, a rear of the shielding shell being coupled with the base body of the insulating housing; and a propping lid having a base block mounted against the rear surface of the base body, and a plurality of insertion bolts protruded forwards from a front face of the base block for being inserted into the corresponding insertion holes of the base body to make the propping lid detachably mounted to the insulating housing, wherein the soldering tails of the terminals can be soldered with cables respectively by means of being positioned against a top and a bottom of the base block, or directly soldered onto a printed circuit board by means of demounting the propping lid from the insulating housing to set the soldering tails free.

2. The plug connector as claimed in claim 1, wherein the insertion hole gradually becomes narrow along the concaved direction thereof, and the insertion bolt gradually thins in diameter along the extending direction thereof to match with the insertion hole.

3. The plug connector as claimed in claim 1, wherein the top and the bottom of the base block of the propping lid respectively define a plurality of positioning fillisters arranged at regular intervals and each extending along a front-to-rear direction to penetrate through the base block, the soldering tails of the terminals are positioned in the positioning fillisters of the propping lid respectively to be propped by the base block.

4. The plug connector as claimed in claim 1, wherein the base body has two indentation areas oppositely provided at middles of top and bottom surfaces thereof and further enlarged to the front of the base body, a wedge is formed in each indentation area, the casing has a top plate and a bottom plate facing the top plate, middles of rear edges of the top plate and the bottom plate are oppositely bent perpendicularly to the top plate and the bottom plate, and then extend rearwards to form a pair of buckling slices, a buckling opening is opened in each of the buckling slices, the buckling slices are disposed in the indentation areas and the wedges are buckled in the corresponding buckling openings for fixing the shielding shell and the insulating housing together.

5. The plug connector as claimed in claim 4, wherein a pair of fastening cavities is opened two opposite sides of the base body, and each extends longitudinally to penetrate through the front of the base body, a locking bump protrudes at each of the fastening cavities, the casing further has two opposite side strips connecting the top plate and the bottom plate, each of the side strips is elongated rearwards to form a clamping arm with a locking hole being opened therein, the clamping arm is inserted in the fastening cavity to be coupled with the base body by means of the locking bump buckled in the locking hole.

* * * * *